United States Patent [19]

Feirer et al.

[11] Patent Number: 4,519,309

[45] Date of Patent: May 28, 1985

[54] SLIDING TOOL TABLE INTENDED FOR THE EXCHANGE OF TOOLS IN PRESSES

[75] Inventors: Egon Feirer, Weingarten; Ulrich Amann; Günter Kuppinger, both of Baindt, all of Fed. Rep. of Germany

[73] Assignee: Maschinenfabrik Müller-Weingarten AG, Weingarten, Fed. Rep. of Germany

[21] Appl. No.: 536,036

[22] Filed: Sep. 26, 1983

[30] Foreign Application Priority Data

May 7, 1983 [DE] Fed. Rep. of Germany ..... 3316815

[51] Int. Cl.[3] ..... B30B 15/00

[52] U.S. Cl. ..... 100/229 R; 72/448; 100/918

[58] Field of Search ..... 100/221, 224, 918, 207, 100/229 R; 414/750; 72/405, 446, 448; 83/637, 698, 699, 700

[56] References Cited

U.S. PATENT DOCUMENTS

| | | | |
|---|---|---|---|
| 3,190,464 | 6/1965 | Johansen | 100/207 X |
| 3,214,958 | 11/1965 | Muller | 100/207 X |
| 3,973,427 | 8/1976 | Shirao | 72/448 |
| 4,106,633 | 8/1978 | Lang | 100/207 X |
| 4,424,742 | 1/1984 | Yamashita | 100/918 X |

*Primary Examiner*—Billy J. Wilhite

*Attorney, Agent, or Firm*—Spencer & Frank

[57] ABSTRACT

For the exchange of tools in a press, the tools, including their associated gripper rail sections, are moved out of the press on a sliding table having a gripper rail support. To ensure that the gripper rails do not block access to the tool, the gripper rail support is adjustable in height. This permits lowering of the gripper rails sections to the extent that access to the tool is unimpeded.

5 Claims, 5 Drawing Figures

SLIDING TOOL TABLE INTENDED FOR THE EXCHANGE OF TOOLS IN PRESSES

BACKGROUND OF THE INVENTION

The present invention relates to a sliding table carrying the tool intended for exchange in a press, with a gripper rail support being disposed at the sliding table or at the tool.

In transfer presses, gripper rail transporting systems are provided to transport the workpieces being processed from one stage to the respective next stage. The gripper rails of such systems extend over the entire length of the press. In order to avoid the need to uncouple the entire gripper rails from their drives during the changing of tools and to then pull them out of the press in the longitudinal direction, the gripper rails are subdivided into individual sections so that the gripper rail sections associated with the respective tool can be brought out of the tool area together with the tool on the sliding table.

In the past, fixed support consoles were provided at the sliding table or at the tool to provide support for the gripper rail sections and the latter were fixed to these consoles.

The dismounted gripper rails, particularly those having large spatial cross sections, have, on occasions, considerably impeded access to the tool outside the tool area.

SUMMARY OF THE INVENTION

It is an object of the present invention to provide a sliding table of the above-outlined type from which the discussed disadvantage is eliminated with a simple design and without undue expenditures.

This object and others to become apparent as the specification progresses, are accomplished by the invention, according to which, briefly stated, the gripper rail support of the sliding table is height-adjustable.

With such a configuration, it is possible to lower the gripper rail sections together with the gripper rail support to such an extent that the tool becomes freely accessible. It is an additional advantage that a form-locking coupling is provided between the gripper rail support and the gripper rail section. A preferred embodiment of such a coupling is characterized in that bearing bosses equipped with guide bores are provided at the gripper rail section and mating pins are disposed at the gripper rail support of a design to correspond to the guide bores.

For the height adjustment of the gripper rail support, according to a preferred embodiment of the present invention a lifting device is provided which includes a lazy tongs-type structure and a fluid pressure operated cylinder unit.

DETAILED DESCRIPTION OF THE INVENTION

Figure 1:
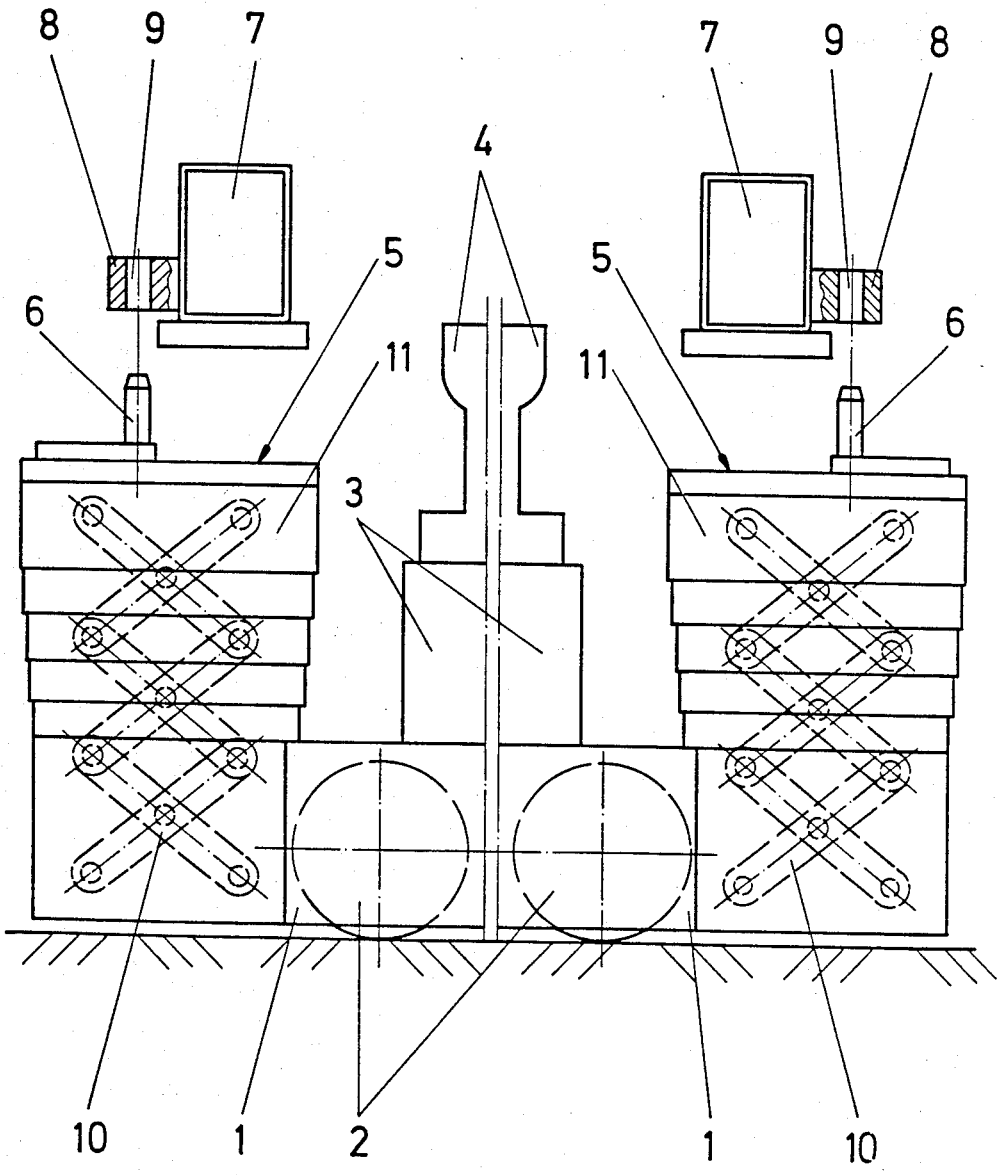
FIG. 1 is a schematic front elevational view of a preferred embodiment of the invention in a non-operational state thereof.

Turning to FIG. 1, there is schematically shown a sliding table 1 provided with wheels 2 and a clamping plate 3 as well as a tool 4 are shown only schematically. FIG. 1 depicts the phase in which a gripper rail support 5 has been lowered during operation of the press to the extent that the gripper rail sections 7 can move as they perform their normal operation, without being impeded by the gripper rail support 5.

Figure 2:
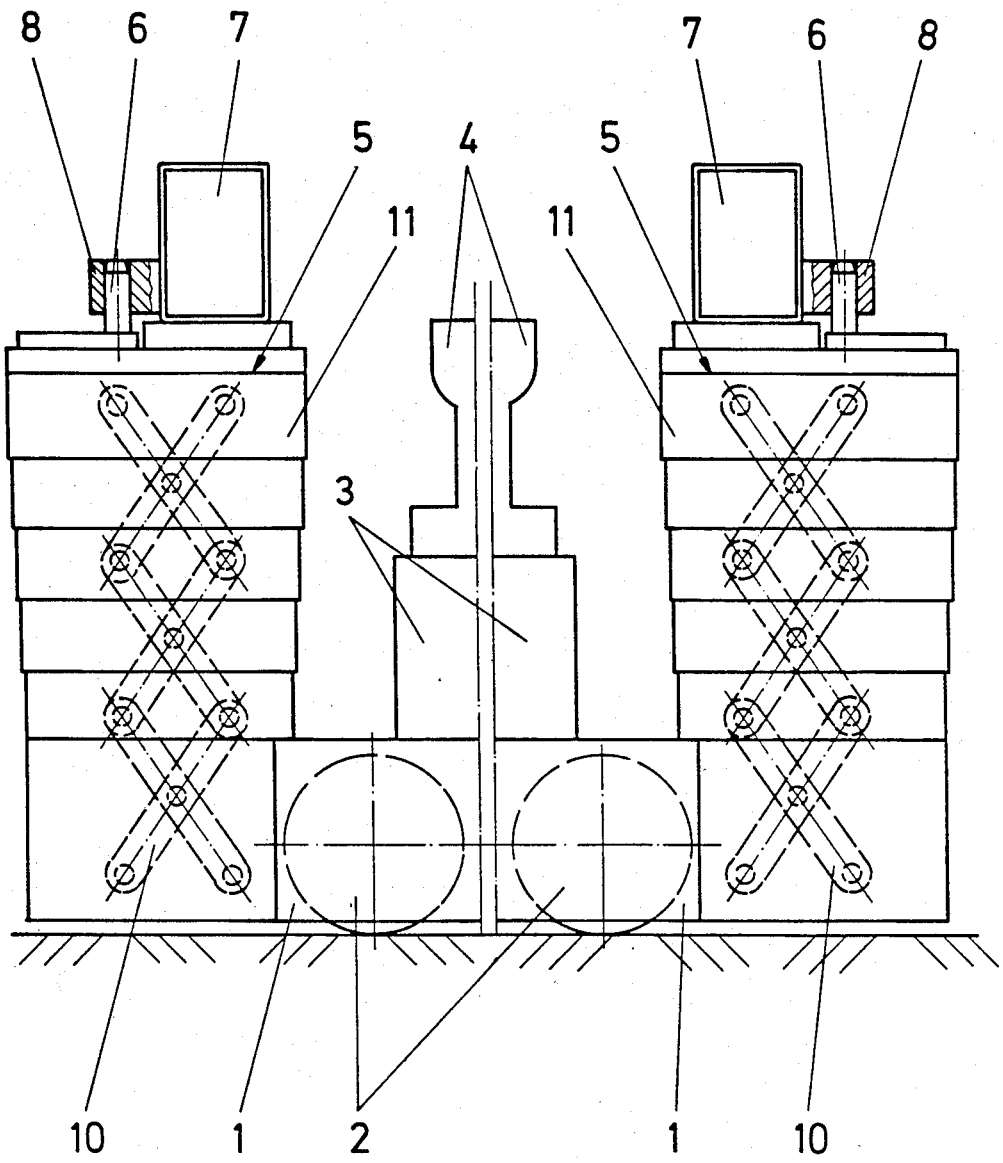
FIG. 2 is similar to FIG. 1, showing the preferred embodiment in an operational phase.

To exchange tools, the gripper rail support 5 is raised into the position shown in FIG. 2 and is form-lockingly coupled with the gripper rail sections 7. For this purpose, bearing bosses 8 equipped with guide bores 9 are provided at the gripper rail sections 7 and pins 6 fastened to gripper rail supports 5 serve as coupling means by entering into guide bores 9 and thus simultaneously fixing the gripper rail sections 7.

Thereafter the gripper rail connections (not shown) are released and the sliding table 1, with the gripper rail sections supported thereon by the gripper rail support 5, can be removed from the tool area 1.

Figure 3:
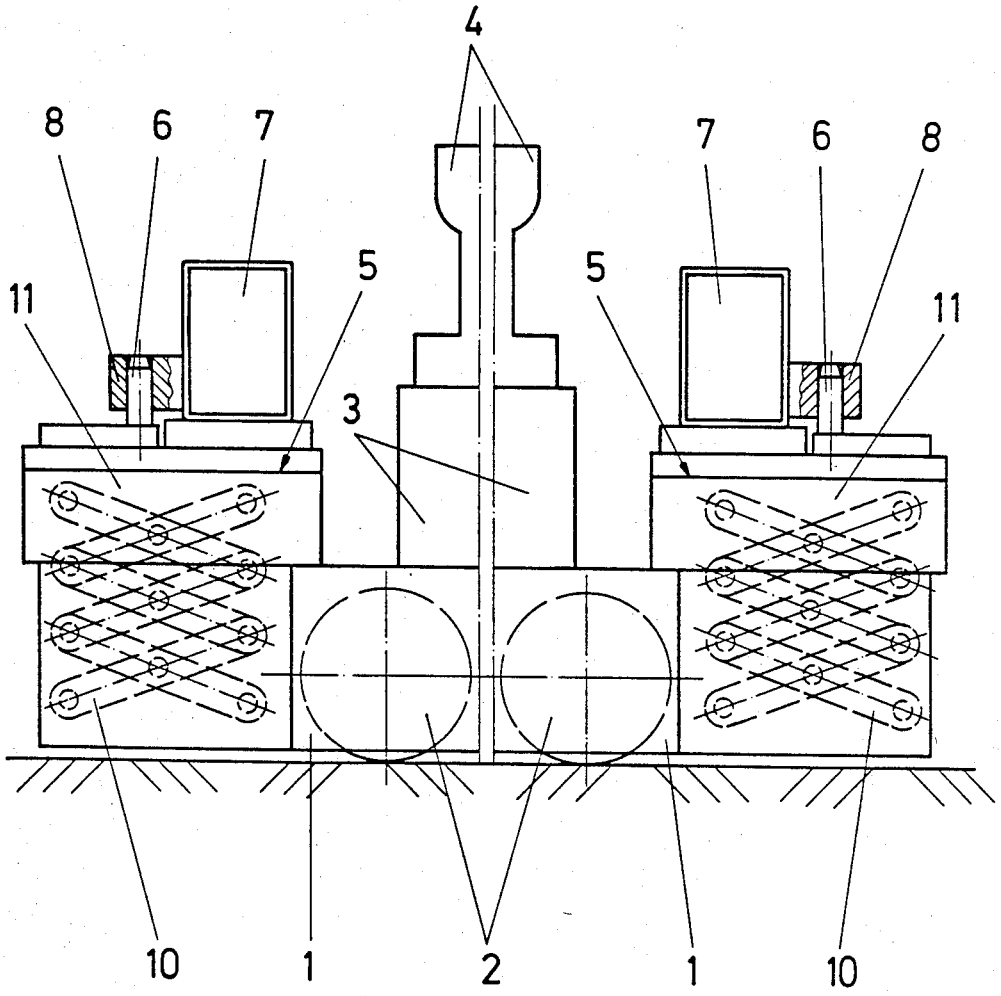
FIG. 3 is similar to FIG. 2, showing the preferred embodiment in another operational phase.

In order to render the tool 4 more accessible, the gripper rail support 5 with gripper rail sections 7 can be lowered into a lower position, as shown in FIG. 3.

Figure 4:
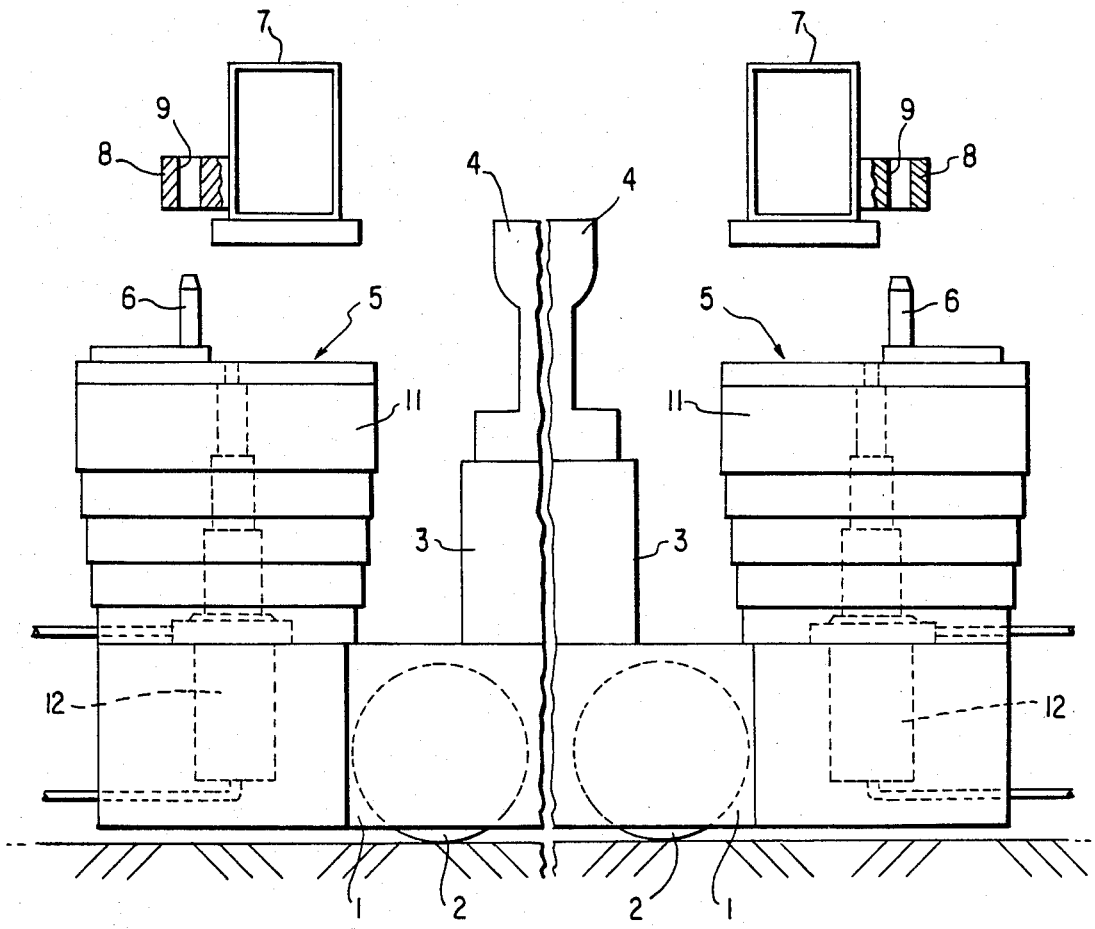
FIG. 4 is a schematic front elevational view of another preferred embodiment.

In the embodiment illustrated in FIGS. 1–3, the lifting device comprises a lazy tongs structure 10 coupled to the gripper rail support 5. However, instead of the tongs 10, a telescoping cylinder 12 as shown in FIG. 4 or other known lifting devices can also be used. The tongs 10 (or the cylinder 12) are equipped, for example, with a telescoping covering 11.

Figure 5:
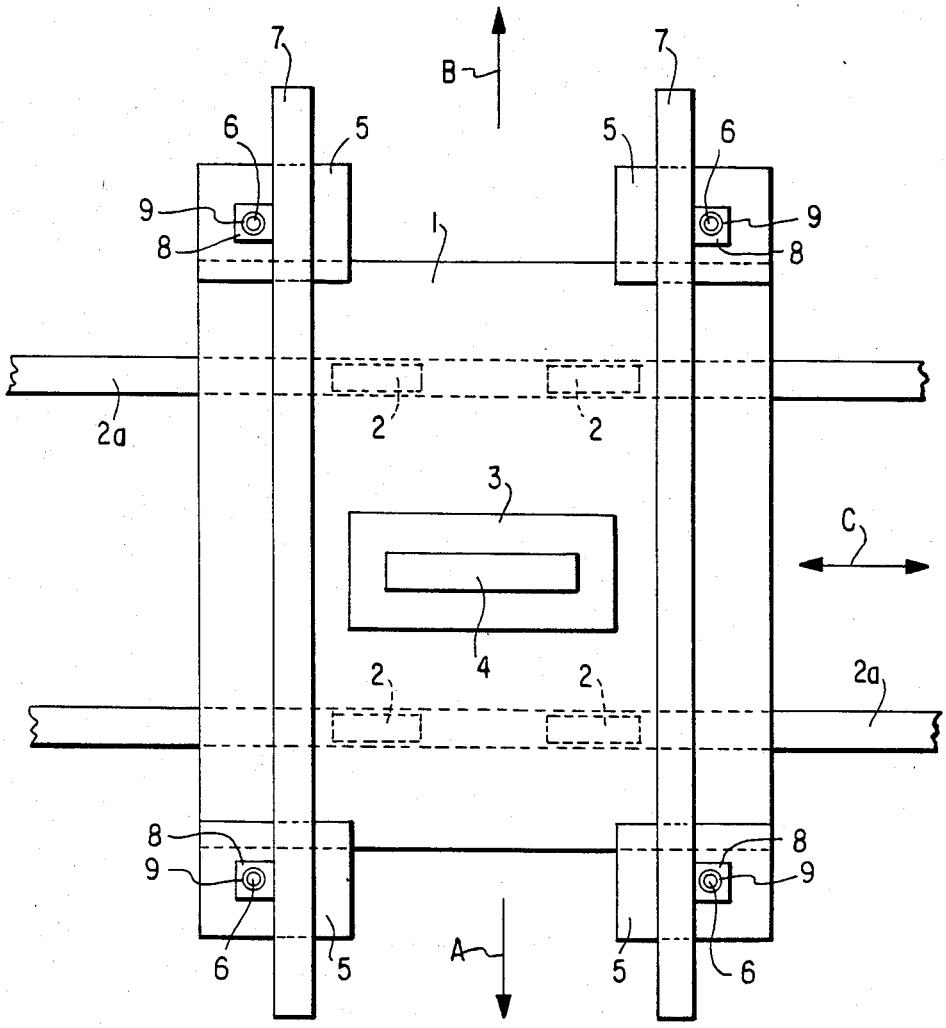
FIG. 5 is a schematic top plan view of the structure illustrated in FIG. 1.

FIG. 5 is a schematic top plan view of the structure shown in FIG. 1. Closest to the observer are the parallel-extending gripper rail sections 7 which, during normal operation of the press and thus in a standby state of the apparatus according to the invention, are conventionally supported by components (not shown) of the press. The table 1, carrying the rail supporting structures 5, is positioned on parallel extending rails 2*a* by means of the wheels 2. It is noted that further gripper rail sections 7 may be provided in alignment with gripper rail sections 7 in the direction of the arrows A and B. Under each such additional gripper rail section pairs, further tables 1 with respective clamping plates 3 and tools 4 may be provided, together with respective gripper rail supports 5 structured according to the invention. The top face of pins 6 fastened to the respective gripper rail supports 5 are visible through the guide bores 9 provided in the bosses 8 of the respective gripper rail sections 7. As described above, for removing the rail sections, the gripper rail supports 5 are raised so that the respective pins 6 project into the receiving bores 9 (as shown in FIG. 2). Subsequently, the rail supports 5, with the gripper rail sections 7 resting thereon, are lowered by the lazy tongs 10 (or by the hydraulic cylinder 12) and then the table 1, together with the supports 5 and the gripper rail sections 7 may be rolled out on the rails 2*a* transversely to the length dimension of the press, as indicated by the double-headed arrow C.

It will be understood that the above description of the present invention is susceptible to various modifications, changes and adaptations, and the same are intended to be comprehended within the meaning and range of equivalents of the appended claims.

What is claimed is:

1. In a press comprising removable gripper rails for conveying workpieces, a sliding table, an exchangeable tool mounted on said sliding table, a gripper rail support means carried by said sliding table, the improvement comprising a raising and lowering means mounted on said table and connected to said gripper rail support means for a height level adjustment of said rail support means.

2. A press as defined in claim 1, further comprising form-fitting means mounted at least in part on said gripper rail support means for form-fittingly receiving the gripper rails.

3. A press as defined in claim 2, wherein said form-fitting means comprises bosses affixed to said gripper rails, means defining a guide bore in each said boss, and pins affixed to said gripper rail support means; each said pin being received by a respective said guide bore as said gripper rails are deposited on said gripper rail support means.

4. A press as defined in claim 1, wherein said raising and lowering means comprises a generally vertically expandable lazy tongs mechanism connected to said sliding table and to said gripper rail support means for varying the height level of said gripper rail support means.

5. A press as defined in claim 1, wherein said raising and lowering means comprises a fluid-pressure operated cylinder.

* * * * *